US009890635B2

(12) United States Patent
Latham

(10) Patent No.: US 9,890,635 B2
(45) Date of Patent: Feb. 13, 2018

(54) TAPERED CUTTER BIT AND MOUNTING BLOCK FOR THE SAME

(71) Applicant: Winchester E. Latham, Avon, IN (US)

(72) Inventor: Winchester E. Latham, Avon, IN (US)

( * ) Notice: Subject to any disclaimer, the term of this patent is extended or adjusted under 35 U.S.C. 154(b) by 0 days.

(21) Appl. No.: 15/196,957

(22) Filed: Jun. 29, 2016

(65) Prior Publication Data

US 2016/0305242 A1 Oct. 20, 2016

Related U.S. Application Data

(63) Continuation of application No. 14/262,918, filed on Apr. 28, 2014, now Pat. No. 9,382,794, which is a continuation-in-part of application No. 14/136,063, filed on Dec. 20, 2013, now Pat. No. 9,394,787.

(51) Int. Cl.

| | |
|---|---|
| ***E21C 35/183*** | (2006.01) |
| ***E21C 35/193*** | (2006.01) |
| ***E21C 25/10*** | (2006.01) |
| ***B28D 1/18*** | (2006.01) |

(52) U.S. Cl.

CPC ..... *E21C 35/183* (2013.01); *B28D 1/188* (2013.01); *E21C 25/10* (2013.01); *E21C 35/1936* (2013.01)

(58) Field of Classification Search

CPC .. E21C 35/19; E21C 35/18; E21C 2035/1806; E21C 2035/1803; E21C 35/183; E21C 35/193; E21C 25/10; E21C 35/1936; B28D 1/188

USPC ... 299/79.1, 87.1, 102, 103, 104, 108, 112 R

See application file for complete search history.

(56) References Cited

U.S. PATENT DOCUMENTS

| | | | | |
|---|---|---|---|---|
| 2,689,108 | A * | 9/1954 | Haglund | E21B 10/56 175/414 |
| 3,429,617 | A | 2/1969 | Lauber | |
| 3,487,865 | A | 1/1970 | Chapman et al. | |
| 3,666,321 | A | 5/1972 | Lundstrom et al. | |
| 3,726,352 | A | 4/1973 | Olov Roos | |
| 4,609,227 | A | 9/1986 | Wild et al. | |
| 4,936,516 | A | 6/1990 | Hench | |
| 5,052,757 | A | 10/1991 | Latham | |
| 5,146,963 | A | 9/1992 | Carpenter et al. | |
| 5,348,065 | A | 9/1994 | Meyer | |
| 5,971,305 | A | 10/1999 | Davenport | |
| 6,523,768 | B2 | 2/2003 | Recker et al. | |
| 7,108,212 | B2 | 9/2006 | Latham | |
| 7,290,726 | B2 | 11/2007 | Latham | |

(Continued)

*Primary Examiner* — Carib A Oquendo

(74) *Attorney, Agent, or Firm* — Brinks Gilson & Lione

(57) ABSTRACT

A cutter bit includes a wear resistant element replaceably mounted to a front surface immediately below the cutting surface of the cutter bit. The body of the cutter bit is generally formed of a hardened steel, the cutting surface can be a diamond composition fixed in a step in the upper end of the cutter bit including side edges that taper laterally outwardly toward a lower edge of the cutting surface situated adjacent to the wear resistant element and the wear resistant element is preferably formed of a carbide composition or a sintered diamond composition. The wear resistant element can have an upper edge that closely conforms to the shape of an adjacent lower edge of the cutting surface, and can be coupled to a front end of a stem passing through an opening in the cutter bit immediately below the cutting surface, the opening being perpendicular to at least a portion of the back surface of the cutter bit.

20 Claims, 10 Drawing Sheets

(56) References Cited

U.S. PATENT DOCUMENTS

| | | | | |
|---|---|---|---|---|
| 7,338,134 | B2 | 3/2008 | Latham | |
| 8,033,308 | B2 | 10/2011 | Stager | |
| 8,079,431 | B1 | 12/2011 | Cooley et al. | |
| 8,424,974 | B2 | 4/2013 | Latham | |
| 8,430,009 | B2 | 4/2013 | Micacchi | |
| 8,501,144 | B1 | 8/2013 | Bertagnolli | |
| 8,528,990 | B2 | 9/2013 | Latham | |
| 8,991,523 | B2 | 3/2015 | Shen et al. | |
| 2005/0098015 | A1* | 5/2005 | Latham | E21C 35/1936 83/698.41 |
| 2010/0043922 | A1 | 2/2010 | Leonardi et al. | |
| 2010/0194176 | A1 | 8/2010 | Lucek et al. | |
| 2014/0339879 | A1 | 11/2014 | Burton et al. | |
| 2015/0240635 | A1 | 8/2015 | Latchmann et al. | |

* cited by examiner

TAPERED CUTTER BIT AND MOUNTING BLOCK FOR THE SAME

CROSS-REFERENCE TO RELATED APPLICATION

This is a continuation of application Ser. No. 14/262,918 filed Apr. 28, 2014, which is a continuation-in-part of application Ser. No. 14/136,063 filed Dec. 20, 2013.

BACKGROUND

This invention generally relates to the field of rotary driven cylindrical scarifiers for use in roadway surface milling. More particularly, the present invention is directed to wear resistant inserts on abrasive cutting elements for such rotary driven cylindrical scarifiers that can be used on equipment for modifying the surface of an existing road, and in particular, to equipment for smoothing areas of existing pavement by removing bumps, upward projections, and other surface irregularities, removing paint stripes, and milling shallow recessed to receive roadway edging and marking tape.

In general, roadway surface milling, planing, mining or reclaiming equipment disclosed in the prior art includes a rotary driven cylindrical comminuting drum which acts to scarify or mine the top portion of the asphaltic road surface in situ. Road planning machines are used to remove bumps and other irregularities on the surface of a road, runway, taxiway, or other stretch of pavement. This planning effect is typically achieved by grinding the paved surface so that the grinding depth may vary slightly, but the surface produced by the grinding unit is more level than the original surface. The road planning machine typically includes a grinding unit that is powered by an engine or motor. A tractor is attached to, or integral with, the grinding unit for propelling the grinding unit against the paved surface in a desired direction.

In some prior art devices of this type, a plurality of cutter bit support members are connected by bolts or by a weld to the curved surface of a drum or to flighting fixed to a drum surface. The plurality of the support members can be arranged end-to-end so as to form a more or less continuous helical pattern. The top surface of the helically arranged support members may be elevated above the curved surface of the drum. The top surfaces of the cutter bit support members can include angled openings into which conventional cutter bits are received. The cutter bits can be a conical cutter with preferably a tungsten carbide tip or the like. The tip can have a variety of shapes.

Examples of a cutter bit holder and drum are disclosed in U.S. Pat. Nos. 4,480,873; 5,052,757; 7,108,212; 7,290,726; and 7,338,134 to Latham where a rotatable drum has a generally cylindrical outer surface, and a plurality of blocks are mounted onto the outer surface of the drum. The blocks can be positioned onto the drum relative to one another such that the blocks define a helical flight extending around the outer surface of the drum, or can be spaced from each other in any desired pattern. Each of the blocks includes a first side wall, a second side wall, and a top surface. The first and second side walls are generally parallel to one another and generally perpendicular to the drum. The top surfaces of the blocks can define an outer periphery of the flight, if so arranged. Each of the blocks includes a slot and at least one pocket formed therein. The slot is generally rectangular and adapted to receive a tool holder. The slot includes first and second slot side walls, a bottom surface and a rear slot wall.

The first and second slot side walls are generally parallel to one another and generally perpendicular to the rear slot wall. The rear slot wall can be oriented at an angle relative to the first and second side walls of the block. A generally rectangular shaped tool or tool holder is received within the slot of each block.

Each block also includes at least one pocket on one of the side walls of the slot. The pocket is generally circular and includes a generally cylindrically shaped retainer positioned therein. Each retainer includes a planar tapered surface that is parallel to and engages one side of the rectangular body of the tool or tool holder within the slot of the block to secure the tool holder in the slot. Each block includes a first hole extending from the second side wall to the rear slot wall. The first hole is oriented generally perpendicular to the rear slot wall. A threaded fastener extends through the hole and engages a threaded bore formed within the tool holder to further secure the tool holder within the slot of the block. Each pocket of each block includes a second hole extending from the pocket to the second side wall that can be oriented generally perpendicular to the second side wall. A threaded fastener can extend through the hole and engage a threaded bore formed within the retainer to pull the retainer within the pocket along a longitudinal axis of the second hole such that the planar tapered surface of the retainer pushes the tool holder against the rear slot wall and the side slot wall to keep the tool holder secured within the slot. This arrangement allows for easy quick replacement of the tool holder when the cutting element or tool held by the tool holder becomes worn or damaged.

More recently, it has been suggested that the cutting surfaces of the cutting tools used in the previously described blocks be formed of a diamond composition such as that disclosed in U.S. Pat. No. 8,501,144 to Bertagnolli. The diamond cutting surfaces can comprise diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. The diamond cutting surfaces thus formed exhibit extremely long life under the very abrasive environments encountered in roadway surface milling, planing, or reclaiming. The abrasive wear is such that the tool held by the tool holder can degrade from contact with the passing drift to such a point as to require replacement of the tool even though the cutting surface is still performing satisfactorily.

Thus, there exists a need in the art for an apparatus having a cutter bit insert for a milling drum, with or without flighting, that is capable of removable attachment to a drum and is resistant to wear, particularly when the cutting element is an extremely long-lasting diamond cutting surface. There is also a need for a cutter bit that can be quickly removed from the drum and replaced so that the down time experience during cutter bit replacement is minimized.

SUMMARY

A cutter bit of the present design can be used with a mounting block that can be adapted to be fixed onto a cutting drum for a scarifying milling machine. The cutter bit can take the form of an elongated body having an upper end including a cutting surface. An upper portion of the elongated body can be generally rectangular, or cylindrical, or other suitable shape. The cutter bit can have a lower end that can be shaped as shown in my earlier patents, for example, U.S. Pat. Nos. 4,480,873; 5.052.757; 7,108,212; and 7,338,134. A lower end of the cutter bit can also have a front surface having an optional lower planar tapered portion, and a back surface obverse to the front surface. The back surface can be planar over at least that portion obverse to the lower planar tapered portion. The cutter bit can include a wear resistant element replaceably mounted to the front surface of the elongated body immediately below the cutting surface. In one embodiment, the elongated body can comprise a hardened steel, while the cutting surface can comprise a diamond composition that can be fixed in a step adjacent the upper end of the elongated body. The cutting surface can comprise diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. The wear resistant element can comprise a carbide composition or a sintered diamond composition. The wear resistant element can have a variety of shapes and angular attitudes to deflect the passing drift away from the cutter bit body. The wear resistant element can be, for example, round, square, rectangular, trapezoidal or other shape, including an irregular shape that is best suited to the cutter bit elongated body or any inclination to which the cutter bit elongated body might be mounted in a mounting block.

In one embodiment, the cutter bit can include an opening through the elongated body immediately below the cutting surface from the front surface to the back surface of the elongated body. A stem can be received in the opening, the stem having a front end and a back end. The wear resistant element can be fixed to the front end of the stem. The wear resistant element can be replaced, when needed, by at least partially removing the stem from the opening and inserting a new stem having a new wear resistant element on the front end of the new stem. A fastener can be removably coupled to the back end of the stem to secure the stem in the opening. The opening receiving the stem can be perpendicular to the back surface of the elongated body. The elongated body can include an angled notch including a surface inclined with respect to the back surface of the stem. The opening receiving the stem can be perpendicular to the inclined surface of the angled notch.

In one embodiment, the cutter bit can include an opening through the elongated body immediately below the cutting surface from the front surface to the back surface of the elongated body. A stem can be received in the opening, the stem having a front end and a back end. A wear resistant element can be fixed to a nut that can be secured to the front end of the stem. The wear resistant element can be replaced, when needed, by loosening the stem from the combined nut and wear resistant element, substituting a new combined nut and wear resistant element, and re-tightening the stem into the new combined nut and wear resistant element.

In one embodiment, the mounting block can have a first side wall, a second side wall, and a top surface. The first and second side walls can be generally parallel to one another and generally perpendicular to the top surface. A slot can be positioned within a first side wall and extend through the top surface. The slot can be generally rectangular and include first and second slot side walls, a bottom surface and a rear slot wall. The first and second slot side walls can be generally parallel to one another and generally perpendicular to the rear slot wall so as to define a generally rectangular slot. The rear slot wall can be oriented at an angle relative to the first and second side walls of the mounting block so that the generally rectangular slot is at an angle. At least one pocket can situated within one of the first and second side walls to intercept the slot, and a retainer can be positioned within each pocket. Each retainer can include a planar laterally tapered surface designed to interact with a surface of the cutter bit elongated body, which can be dimensioned to be removably mounted within the slot. Optionally, the at least one pocket can be inclined with respect to the first and second side walls.

In one embodiment, the optional lower tapered portion of the cutter bit can include a pair of vertically spaced tapered portions, each tapered portion contacting the planar laterally tapered surface of one of the retainers. The rectangular elongated body portion of the cutter bit can also include an opening laterally aligned with respect to the cutting surface and adapted to receive a fastener coupling the elongated body portion to the slot back wall.

In one embodiment, the cutter bit lower portion can take a form similar to that shown in U.S. Pat. No. 7,300,115 to Holl et al. An upper portion can take the form of a generally rectangular elongated body having an upper end including a cutting surface. The cutter bit can also have a front surface and a back surface obverse to the front surface. The cutter bit can include a wear resistant element replaceably mounted to the front surface immediately below the cutting surface. The cutter bit body can comprise a hardened steel, the diamond cutting surface can be fixed in a step in the upper end of the cutter bit body, and the wear resistant element can comprise a carbide composition or a sintered diamond composition. The wear resistant element can have a variety of shapes and angular attitudes to deflect the passing drift away from the cutter bit body.

In one embodiment the cutting surface can have side edges that taper laterally outwardly toward the lower edge of the cutting surface that is adjacent to the wear resistant element. The laterally outwardly tapering edges of the cutting surface can assist in protecting the cutter bit body from wear caused by the passing drift. In one embodiment, the upper edge of the wear resistant element can be formed to closely conform to the shape of the adjacent lower edge of the cutting surface to inhibit wear of the cutter bit body between the cutting surface and the wear resistant element.

One feature of the apparatus is that the wear resistant element can be replaceably mounted to the front surface of the cutter bit immediately below the cutting surface. The feature has the advantage of permitting serial replacement of the wear resistant element without requiring that the cutter bit be removed for the mounting block holding the cutter bit, thereby lowering hardware replacement time and providing extended life for the cutter bit. Alternatively, in some circumstances, the wear resistant element can merely be rotated to a new orientation relative to the cutter bit thereby lowering hardware replacement costs.

Another feature of the apparatus is that the wear resistant elements can be provided with a variety of shapes and angular attitudes. This feature has the advantage of not merely resisting but also deflecting the passing drift away from the cutter bit body, thereby extending the life of the cutter bit body.

Another feature of the apparatus is that the mounting blocks can be secured to the cutter drum surface in a variety of patterns to define virtually any lacing pattern. The mounting blocks can be secured to the cutter drum in spaced relation to each other, or immediately adjacent to each other so as to define a flighting.

These and other features and their corresponding advantages of the disclosed combination will become readily apparent to those skilled in the art from the following detailed description of a preferred embodiment when considered in the light of the accompanying drawings.

DESCRIPTION OF PREFERRED EMBODIMENTS

Figure 1:
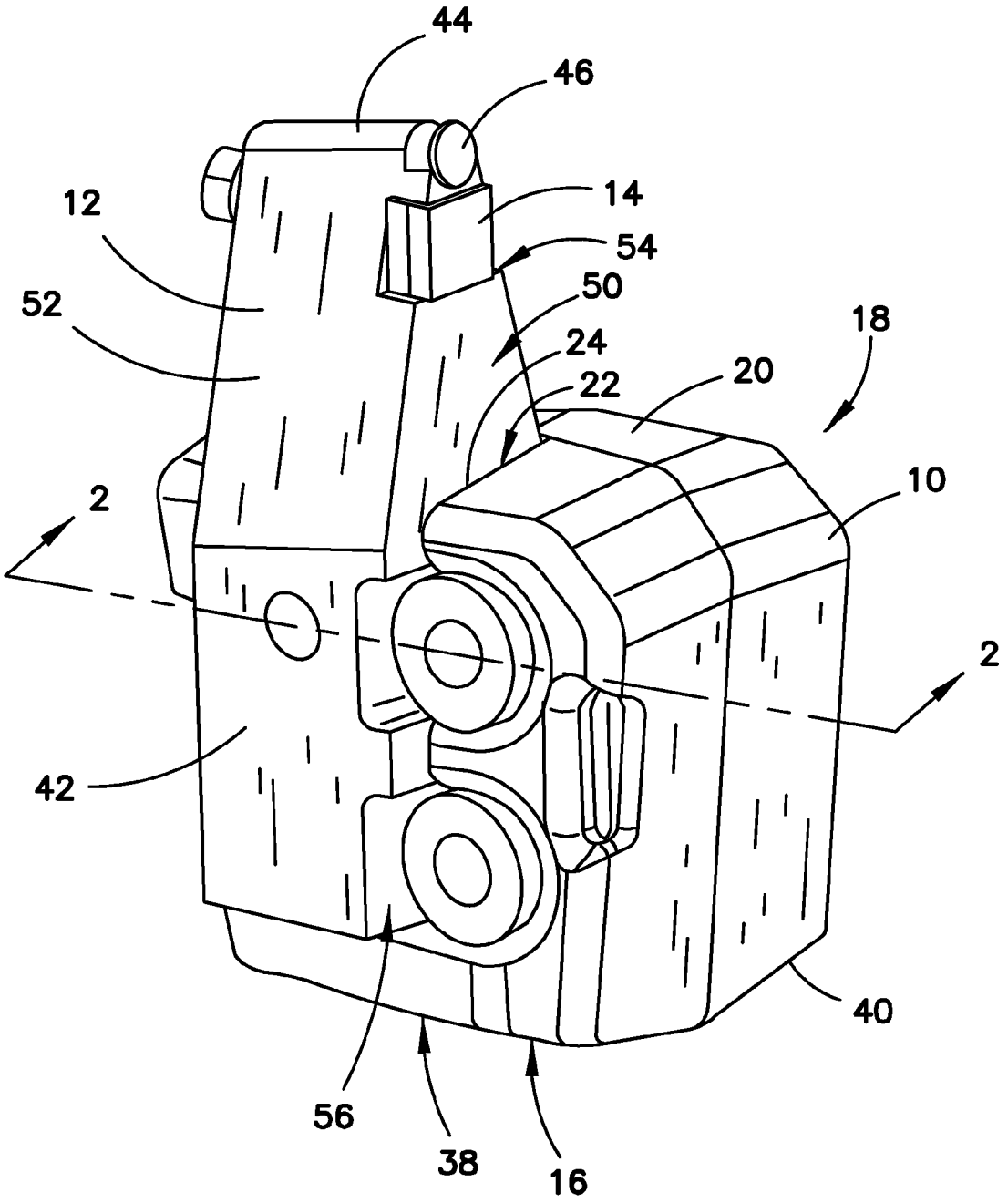
FIG. 1 is a perspective view of a mounting block holding a cutter bit having a replaceable wear resistant insert.
Figure 2:
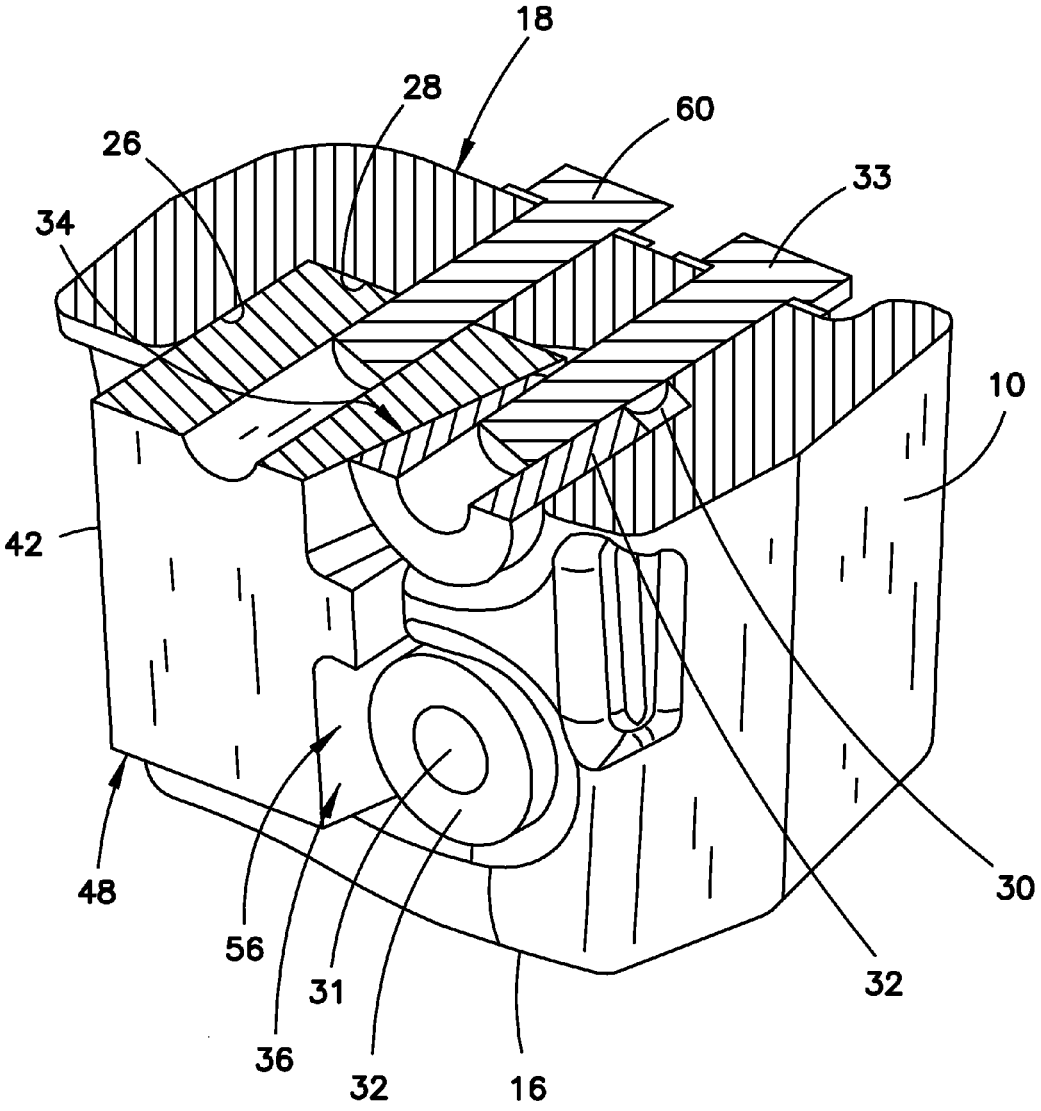
FIG. 2 is a perspective view taken with a top section removed along line 2-2 of FIG. 1.

With reference to all the drawings, the same reference numerals are generally used to identify like components. FIG. 1 is a perspective view of a mounting block 10 holding a cutter bit 12 having a replaceable wear resistant element 14. The mounting block 10 can have a first side wall 16, a second side wall 18, and a top surface 20. The first and second side walls 16, 18 can be generally parallel to one another, as shown in FIG. 2. The first and second side walls 16, 18 can be generally perpendicular to the top surface 20. A slot 22 can be positioned within the first side wall 16 and extend through the top surface 20. The slot 22 can be generally rectangular and include a first slot sidewall 24 and a second slot side wall 26, and a rear slot wall 28. The first and second slot side walls 24, 26 can be generally parallel to one another and generally perpendicular to the rear slot wall 28 so as to define a generally rectangular slot. The rear slot wall 28 can be parallel to or oriented at any angle relative to the first and second side walls 16, 18 of the mounting block 10 so that the generally rectangular slot 22 can be situated at any angle. At least one pocket 30 can situated within the first side wall 16 to intercept the slot 22. The least one pocket 30 can alternatively be situated within the second side wall 18 to intercept the slot 22. A retainer 32 can be positioned within each pocket 30. Each retainer 32 can include a planar laterally tapered surface 34 designed to interact with a surface 36 of the elongated body of the cutter bit 12. Each retainer 32 can include an opening 31 adapted to receive a suitable fastener 33 extending inward from the second side wall 18. The mounting block 10 can have a lower surface 38 having curvature suitable for mating with the surface of a rotatable drum or other working surface of a roadway surface milling, planing, or reclaiming machine or other equipment in a variety of patterns and alignments. The lower surface 38 can include a perimeter 40 adapted for welding attachment to the rotatable drum or other working surface.

In the embodiment of the cutter bit 12 shown in FIGS. 1-4, the cutter bit has a generally rectangular body 42 dimensioned to be removably mounted within the slot 22. The cutter bit can also have an upper end 44 including a cutting surface 46 situated contiguous to the upper end 44. The cutting surface 46 can be formed of a diamond composition and can have a variety of shapes. The diamond composition can be diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. The cutter bit 12 can also have a lower end 48, and a front surface 50. The front surface 50 can optionally have a lower planar tapered portion 56 that can be engaged by the laterally tapered surface 34 of each retainer 32 to secure the cutter bit 12 within the slot 22. A wear resistant element 14 can be replaceably mounted to the front surface 50 immediately below the cutting surface 46 and above the top surface 20 of the mounting block 10. The cutter bit 12 can have lateral tapered surfaces 52 extending from the upper end 44 down to the rectangular body 42. The wear resistant element 14 can be received in a slot 54 in the front surface 50, and can extend substantially entirely between the lateral tapered surfaces 52. The wear resistant element 14 can have a variety of shapes and angular attitudes to deflect the passing drift away from the cutter bit body. The vertical extent and shape of the wear resistant element 14 can be adapted as needed to protect the front surface 50 of the cutter bit 12 from excessive wear by contact with the abrasive drift removed from the surface being milled, preferably to a preferred side of the cutter bit 12.

Figure 3:
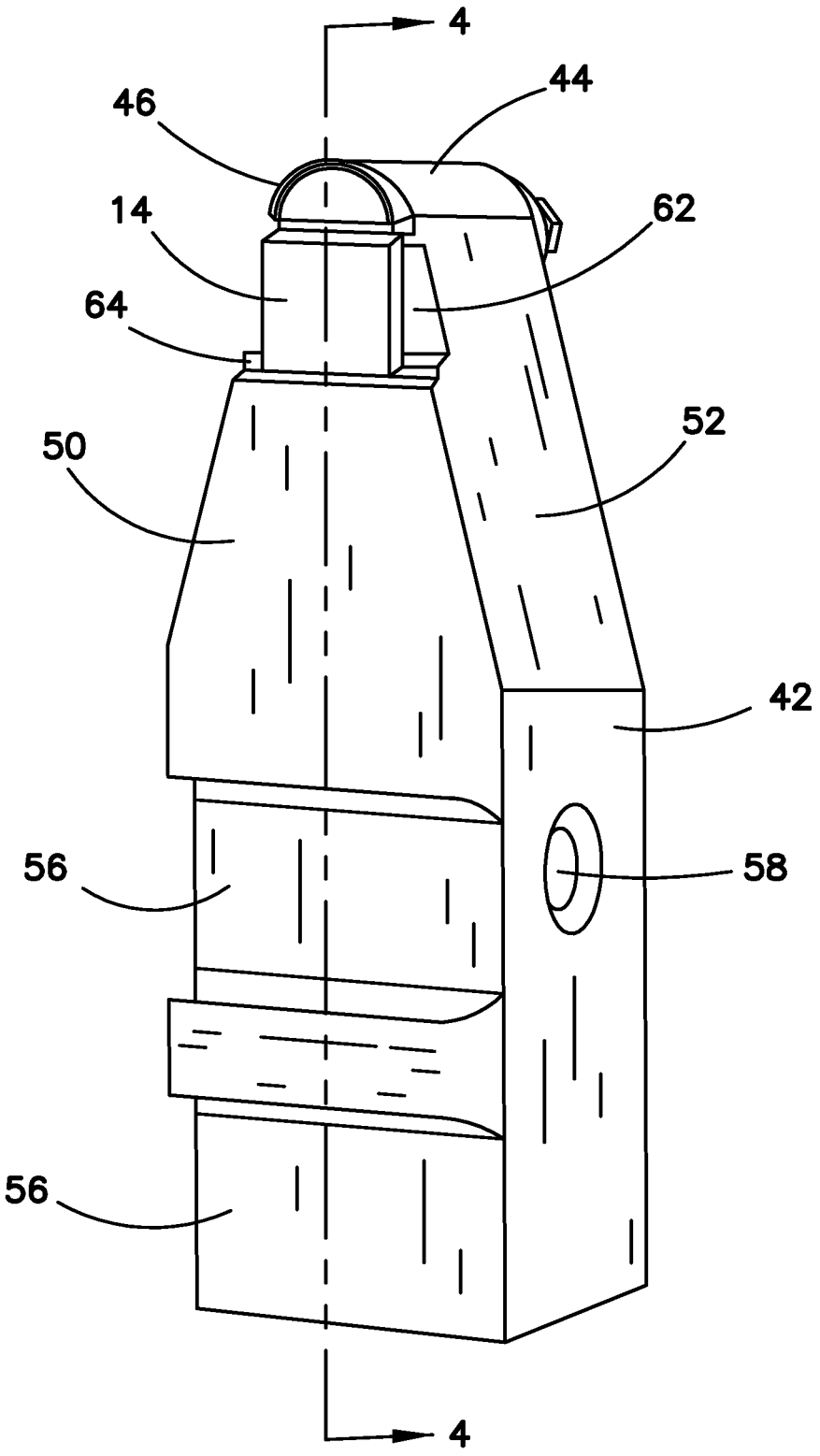
FIG. 3 is a perspective view of another cutter bit having a replaceable wear resistant insert.

As seen in FIGS. 2 and 3, the front surface 50 of the cutter bit 12 can include a pair of vertically spaced tapered portions 56, each tapered portion being dimensioned to be contacted by the planar laterally tapered surface 34 of one of the retainers 32. While FIG. 2 shows the retainer 32 being pulled by fastener 33 into the contacting relationship with the tapered portion 56, the tapered portions 56 of the cutter bit 12 can be omitted. Where the front surface 50 has no tapered portions 56, the pocket 30 and the opening for the fastener 33 can be inclined with respect to the front surface 50 of the cutter bit, so that the laterally tapered surface 34 of the retainer 32 contacts the front surface 50. The rectangular elongated body portion 42 of the cutter bit can also include an opening 58 laterally aligned with respect to the cutting surface 46 and adapted to receive a fastener 60 extending inward from the second sidewall 18 to couple the elongated body portion 42 to the slot rear wall 28. In the event that the cutter bit 12 as a whole needs replaced, the fasteners 33 can be removed from the openings 31 in each retainer 32. The fastener 60 can be removed from opening 58 and the cutting bit 12 laterally removed from the holding block 10. The cutter bit 12 and the holding block 10 can have a variety of shapes and sizes, and can be mounted to a working surface of a variety of roadway surface milling, planing, mining or reclaiming machines and equipment in a variety of patterns and alignments.

Figure 4:
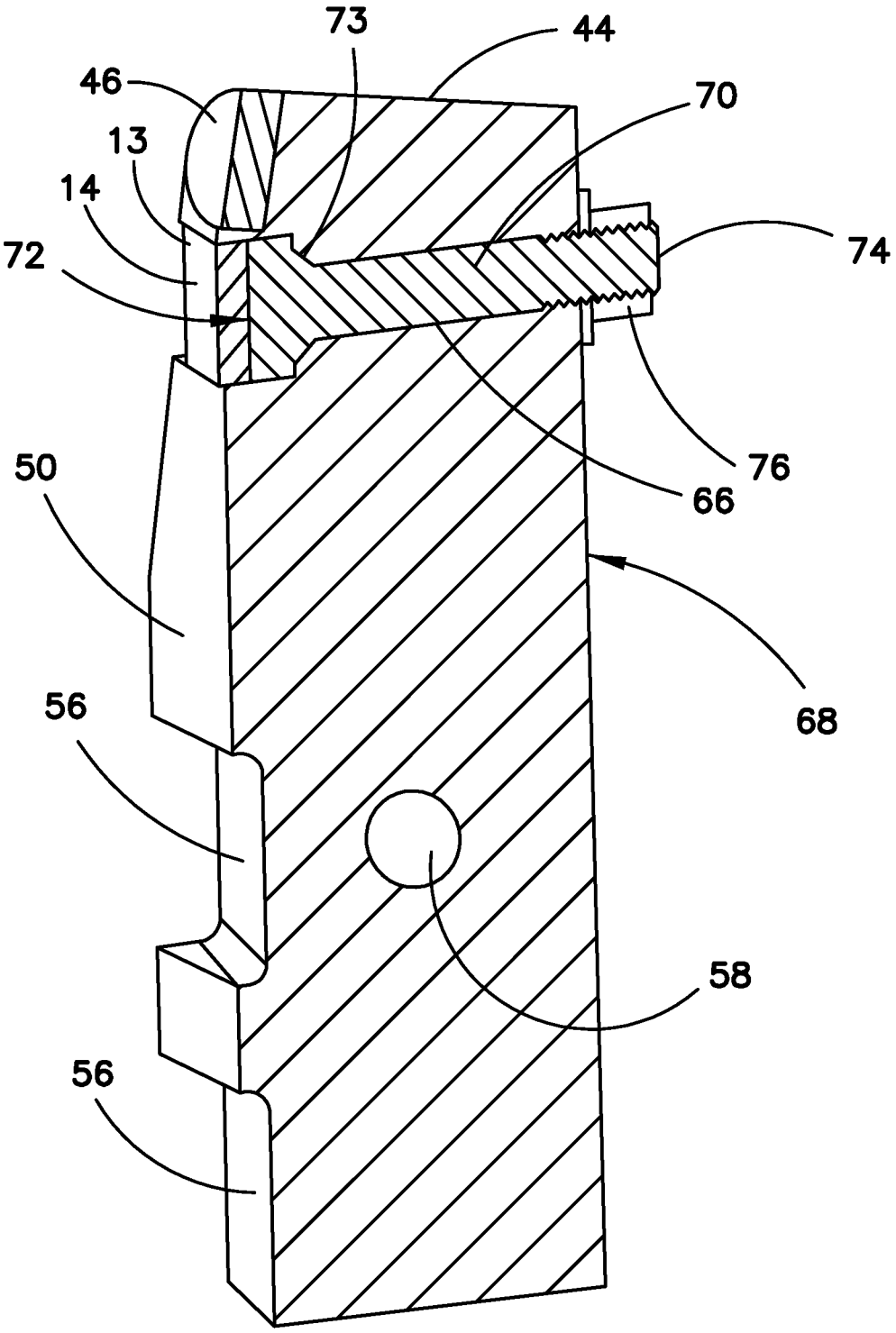
FIG. 4 is vertical sectional view of the cutter bit shown in FIG. 1.

As seen in FIGS. 1, 3, and 4, the cutting surface 46 can have a variety of shapes and sizes. In a preferred embodiment the cutting surface 46 comprises a diamond composition fixed in a step 62 in the upper end 44 of the cutter bit 12. The elongated body 42 of the cutter bit is typically formed of a hardened steel, while the wear resistant element 14 preferably comprises a carbide composition that significantly resists wear from the passing abrasive drift removed from the surface being milled. As seen if FIG. 3, both the cutting surface 46 and the surface of the wear resistant element 14 can be recessed from the front surface 50 of the cutter bit 12 by a further step 64

FIG. 4 is a vertical sectional view of the cutter bit 12 shown in FIG. 1, but is representative of a preferred mounting for the wear resistant element 14. The cutter bit 12 can include an opening 66 through the elongated body 42 immediately below the cutting surface 46 from the front surface 50 to the back surface 68 of the elongated body. A stem 70 having a front end 72 and a back end 74 can be received in the opening 66. The wear resistant element 14 can be fixed to the front end 72 of the stem 70. A fastener 76 can be removably coupled to the back end 74 of the stem 70 to secure the stem in the opening 66. The stem 70 can include a tapered portion 73 which can act to ensure the proper positioning of the wear resistant element 14. Depending on the configuration of the front surface 13 of the wear resistant element, the wear resistant element may be rotated from time to time to lengthen the life of the wear resistant element 14. The wear resistant element 14 can be replaced, when needed, by removing the fastener 76 from the stem 70, and forcing the stem 70 from the opening 66, typically by a moderate tap from a hammer or the like. A new stem 70 having a new wear resistant element 14 on the front end 72 can then be inserted in the opening 66 and secured in place by fastener 76. This arrangement permits serial replacement of the wear resistant element 14 without requiring that the cutter bit 12 be removed for the mounting block 10 holding the cutter bit, thereby lowering hardware replacement time and providing extended life for the cutter bit 12.

Figure 5:
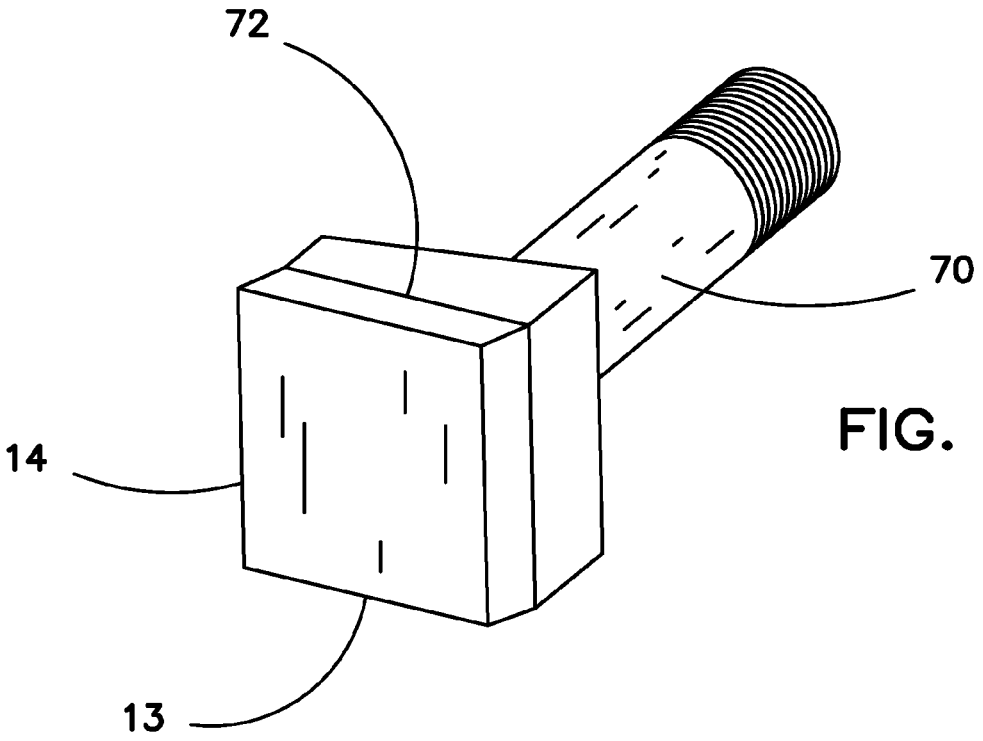
FIG. 5 is a perspective view of a replaceable wear resistant insert having an inclined front face.
Figure 6:
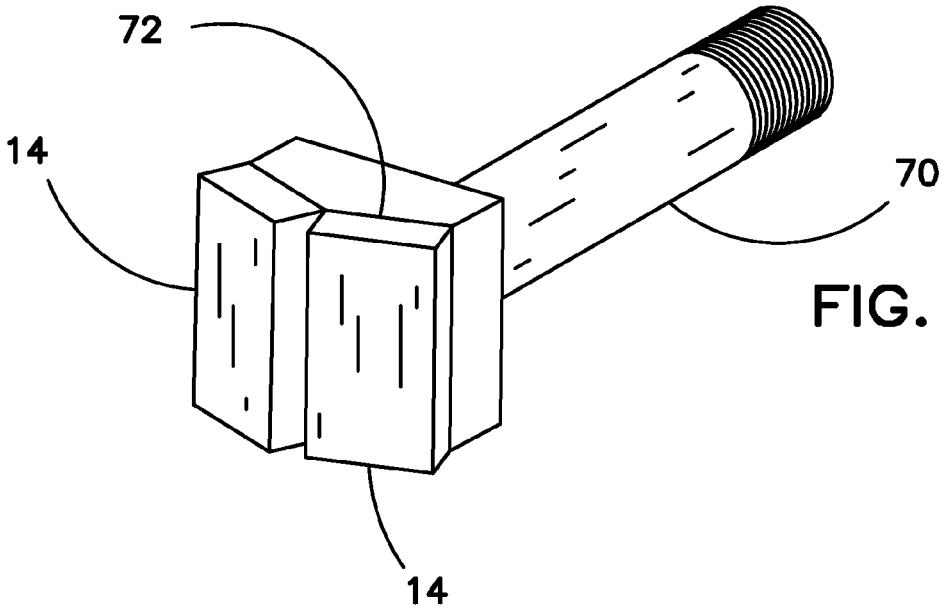
FIG. 6 is a perspective view of a replaceable wear resistant insert having a dual inclined front face.
Figure 7:
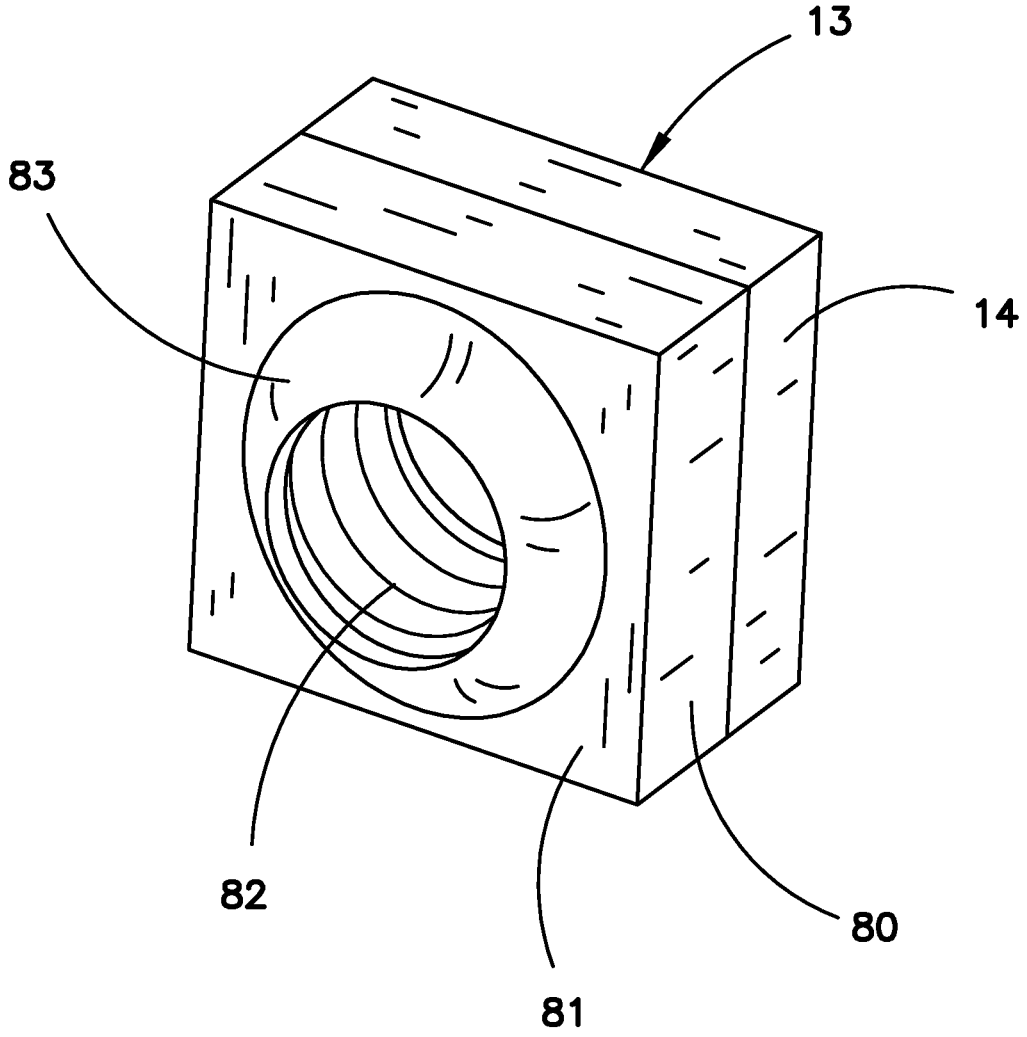
FIG. 7 is a perspective view of a replaceable wear resistant insert formed as a nut to be secured to cutter bit mounting block by a separate fastener.

FIGS. 5-7 show some examples of variations in wear resistant elements 14 that can be formed to be coupled to any of the cutter bits 12 illustrated herein, as well as other non-illustrated cutter bits, so as to protect the front surface 50 of the cutter bit 12 from excessive wear by contact with the abrasive drift removed from the surface being milled. As shown in FIG. 5, the front end 72 of the stem 70 can be inclined with respect to a surface perpendicular to the stem 70. The wear resistant element 14 can be fixed to the front end 72 of the stem 70 so that the front surface 13 of the wear resistant element is also inclined with respect to the stem 70. The wear resistant element 14 shown in FIG. 5 can be inserted into an opening 66 of any cutter bit 12 so that the front surface 13 is inclined to either side of the cutter bit, or upward or downward so as to deflect the passing drift away from the cutter bit body, thereby extending the life of the cutter bit body.

The front end 72 of the stem 70 can also be doubly inclined with respect to a surface perpendicular to the stem 70 as shown in FIG. 6. Wear resistant elements 14 can be fixed to the front end 72 of the stem 70 so that the front surfaces13 of the wear resistant elements are also inclined with respect to the stem 70. The wear resistant elements 14 shown in FIG. 6 can be inserted into an opening 66 of any cutter bit 12 so that the front surfaces 13 are inclined to deflect the passing drift to both sides of the cutter bit body, thereby extending the life of the cutter bit body. While FIGS. 6 and 7 have shown two particularly useful shapes and angular attitudes for the wear resistant elements 14, other useful shapes will be apparent to those skilled in the art.

FIG. 7 shows an alternate arrangement for a wear resistant element 14 wherein the wear resistant element 14 can be fixed to a nut 80 having a treaded interior surface 82 that can be secured to a bolt or other threaded fastener that can be inserted into the opening 66 from the back surface 68 of the elongated body shown in FIG. 4. The back surface 81 of the nut 80 can include a tapered portion 83 to help center and lock the nut 80 within the step 62 below the diamond cutting surface 46. The combined nut 80 and wear resistant element 14 can be rotated an necessary to preserve the life of the wear resistant element 14. The wear resistant element 14 can be replaced, when needed, by loosening the bolt from the combined nut 80 and wear resistant element 14, substituting a new combined nut 80 and wear resistant element 14, and re-tightening the bolt into the new combined nut and wear resistant element. The front surface 13 of the combined nut 80 and wear resistant element 14 can have a variety of useful shapes and angular attitudes, including those useful shapes and angular attitudes shown in FIGS. 5 and 6.

Figure 8:
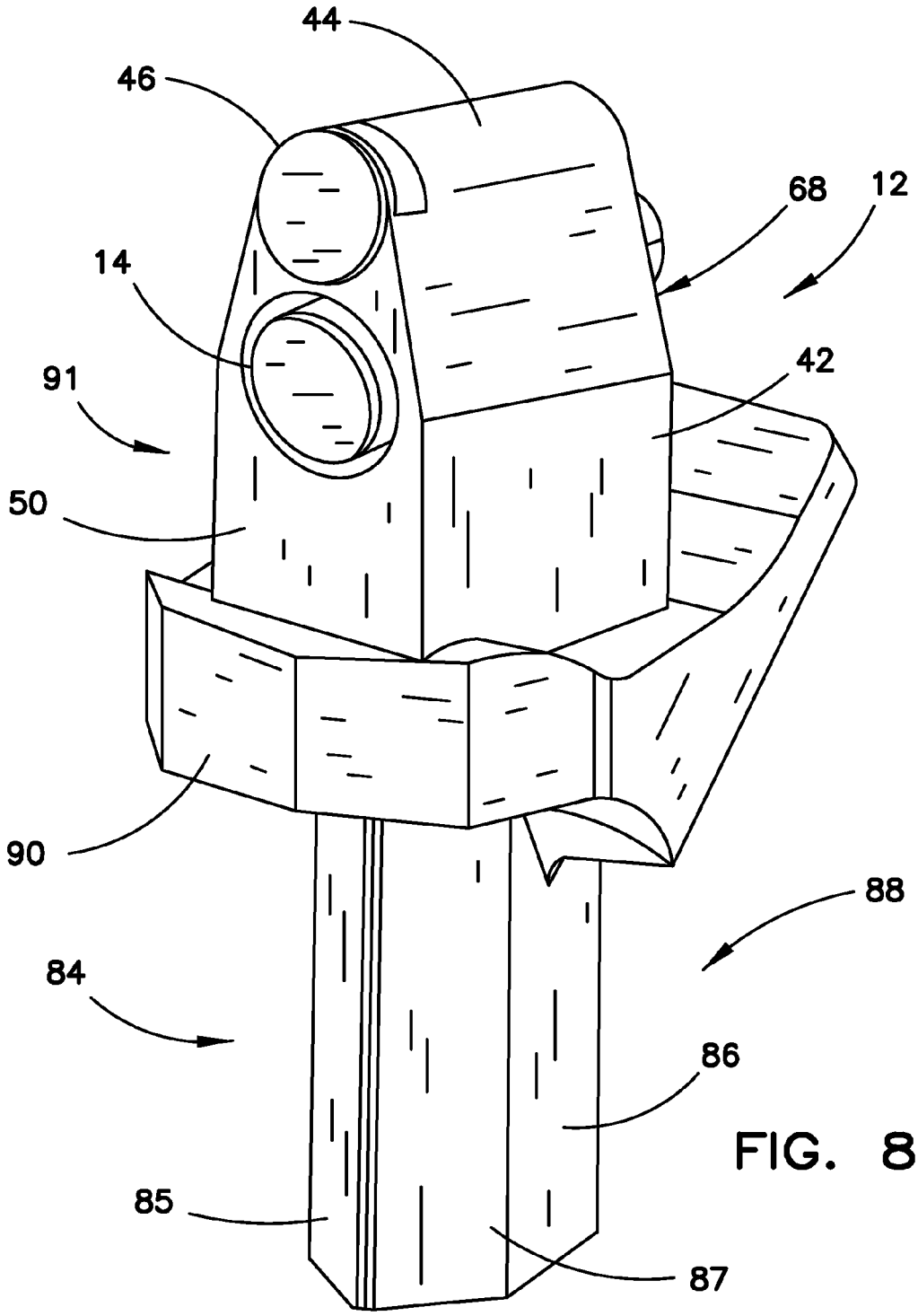
FIG. 8 is a perspective view of another cutter bit having a replaceable wear resistant insert.

FIG. 8 shows another cutter bit 12 having a replaceable wear resistant insert 14. A lower portion 84 of the cutter bit 12 can take a form similar to that shown in U.S. Pat. No. 7,300,115 to Holl et al., including a stem 86 designed to be received into a suitable mounting block, not shown. The stem 86 can include spaced tapered portions 85, 87 on a forward surface of the stem, and a clamping face 88 on a rearward surface of the stem, which act to ensure alignment of the cutter 12 in a desired direction with respect to the mounting block in which the stem 86 is received. A plate 90 can be provided at an upper end of the stem 86. An upper portion 91 can be fixed to an upper surface of the plate 90, and can take the form of a generally elongated body 42 having an upper end 44 including a cutting surface 46. The stem 86 including the spaced tapered portions 85, 87 can be directed to ensure a desired rake angle of the diamond cutting surface 46 and to ensure the top surface 44 is parallel to the center line of the drum forming the working surface. The cutter bit upper portion 91 can also have a front surface 50 and a back surface 68 obverse to the front surface 50. The cutter bit upper portion 91 can include a wear resistant element 14 replaceably mounted to the front surface 50 immediately below the cutting surface 46. The cutter bit body 42, stem 86, and plate 90 can comprise a hardened steel. The cutting surface 46 can comprise a diamond composition which can be fixed in a step 62 adjacent the upper end 44 of the cutter bit body 42. The wear resistant element 14 can comprise a carbide composition or a sintered diamond composition. The wear resistant element 14 can have a variety of shapes and angular attitudes, including those illustrated in FIGS. 1, 3, and 4-8, to deflect the passing drift away from the cutter bit body 42. The wear resistant element 14 can additionally have a variety of other shapes including, for example, round, square, rectangular, trapezoidal or other shape, including an irregular shape that is best suited to the shape of the cutter bit elongated body 42 or any inclination to which the cutter bit elongated body might be mounted in a mounting block.

Figure 9:
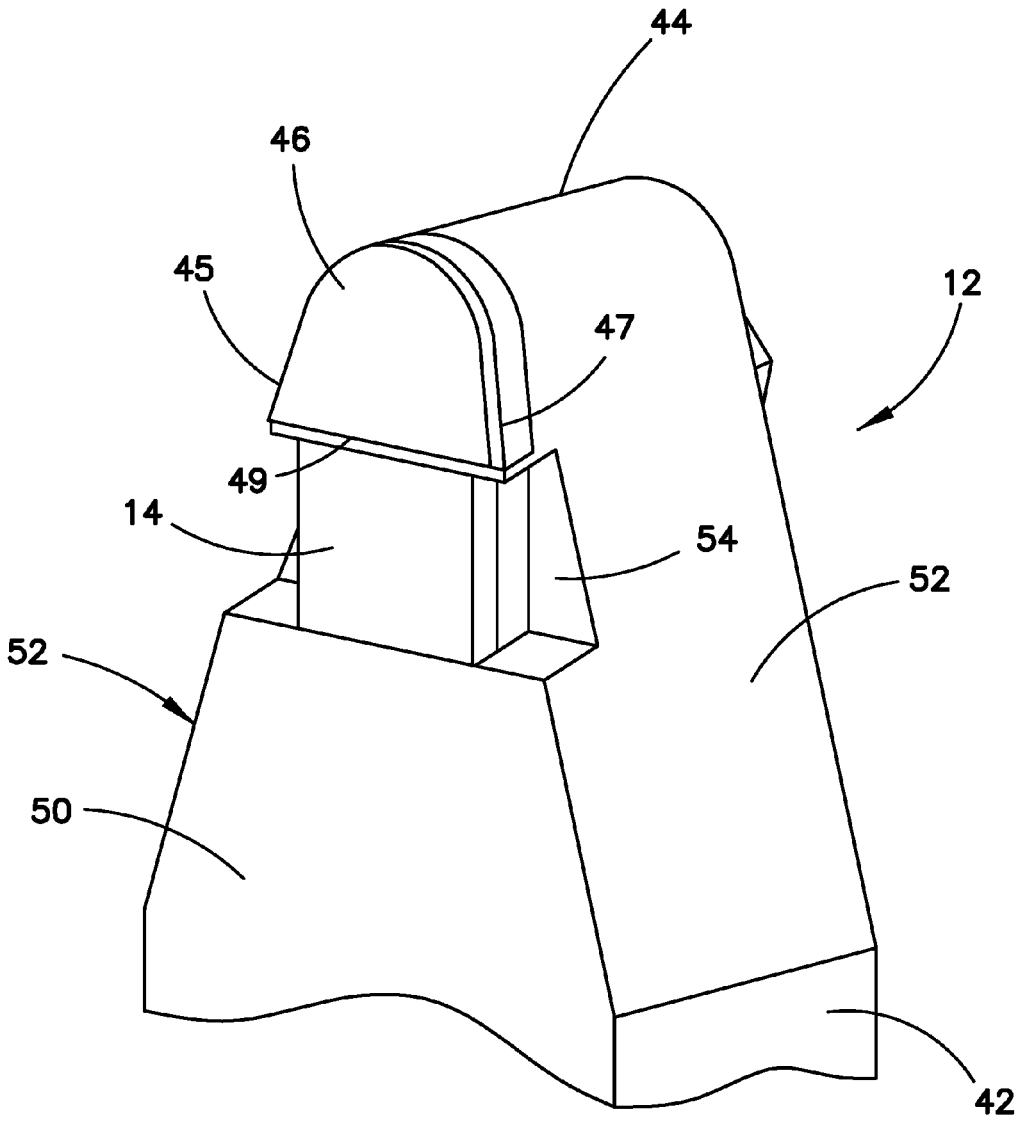
FIG. 9 is a perspective view of another cutter bit having a replaceable wear resistant insert and a cutting surface having laterally outwardly tapering side edges.

In the embodiment of the cutter bit 12 shown in FIG. 9, the cutter bit has a generally rectangular body 42. The cutter bit 12 can also have an upper end 44 including a cutting surface 46 situated contiguous to the upper end 44. The cutting surface 46 can be formed of a diamond composition and can have side edges 45 and 47 that taper laterally outwardly toward a lower edge 49 adjacent to the wear resistant element 14. The laterally outwardly tapering edges 45 and 47 of the cutting surface 46 can assist in protecting the cutter bit 12 from wear caused by passing drift. The diamond composition forming the cutting surface 46 can be diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. The cutter bit 12 can also have a lower end 48 that can be configured variously such as shown in FIG. 3 or FIG. 8. The cutter bit 12 can have a front surface 50. A wear resistant element 14 can be replaceably mounted to the front surface 50 immediately below the lower edge 49 of the cutting surface 46. The cutter bit 12 can have lateral tapered surfaces 52 extending from the upper end 44 down to the rectangular body 42. The wear resistant element 14 can be received in a slot 54 in the front surface 50, and can extend substantially entirely between the lateral tapered surfaces 52. The wear resistant element 14 can have a variety of shapes and angular attitudes to deflect the passing drift away from the cutter bit body as shown, for example, in FIGS. 5 and 6. The vertical extent and shape of the wear resistant element 14 can be adapted as needed to protect the front surface 50 of the cutter bit 12 from excessive wear by contact with the abrasive drift removed from the surface being milled, preferably to a preferred side of the cutter bit 12.

Figure 10:
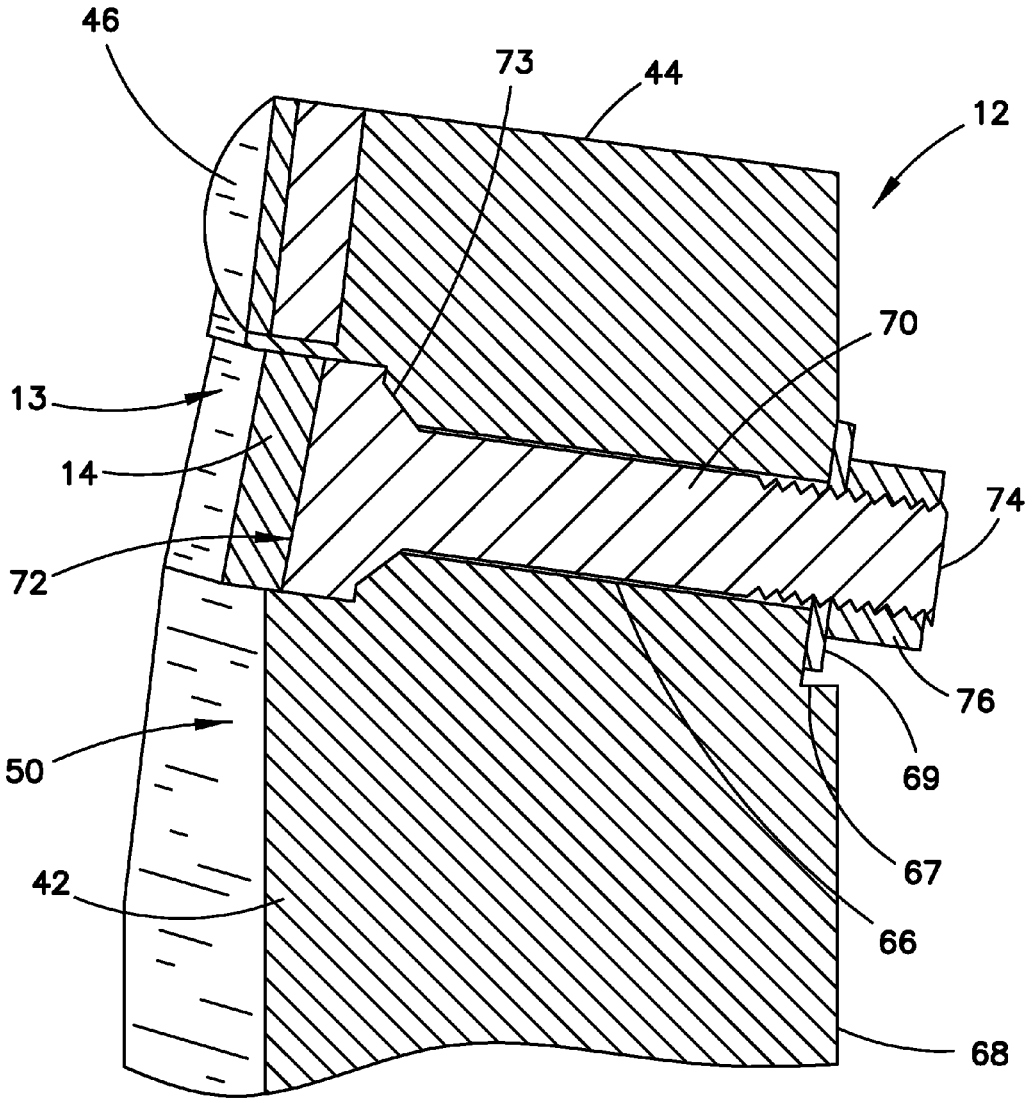
FIG. 10 is a sectional view, somewhat similar to FIG. 4, of an upper portion of another cutter bit including an angled notch having a surface inclined with respect to the back surface of the stem.

FIG. 10 is a vertical sectional view of another cutter bit 12 showing another preferred mounting for the wear resistant element 14. The cutter bit 12 can include an opening 66 through the elongated body 42 immediately below the cutting surface 46 from the front surface 50 to the back surface 68 of the elongated body 42. The back surface 68, which can be generally parallel to the front surface 50 can include an angled notch 67 including a surface 69 inclined with respect to the back surface 68 of the body 42. The opening 66 can be perpendicular to the back surface 68 of the body 42 as shown in FIG. 4. Alternatively, the opening 66 can be perpendicular to the inclined surface 69 of the angled notch 67. A stem 70 having a front end 72 and a back end 74 can be received in the opening 66. The wear resistant element 14 can be fixed to the front end 72 of the stem 70. A fastener 76 can be removably coupled to the back end 74 of the stem 70 to secure the stem in the opening 66. The stem 70 can include a tapered portion 73 which can act to ensure the proper positioning of the wear resistant element 14. Depending on the configuration of the front surface 13 of the wear resistant element, the wear resistant element may be rotated from time to time to lengthen the life of the wear resistant element 14. The wear resistant element 14 can be replaced, when needed, by removing the fastener 76 from the stem 70, and forcing the stem 70 from the opening 66, typically by a moderate tap from a hammer or the like. A new stem 70 having a new wear resistant element 14 on the front end 72 can then be inserted in the opening 66 and secured in place by fastener 76. This arrangement permits serial replacement of the wear resistant element 14 without requiring that the cutter bit 12 be removed for the mounting block 10 holding the cutter bit, thereby lowering hardware replacement time and providing extended life for the cutter bit 12

Figure 11:
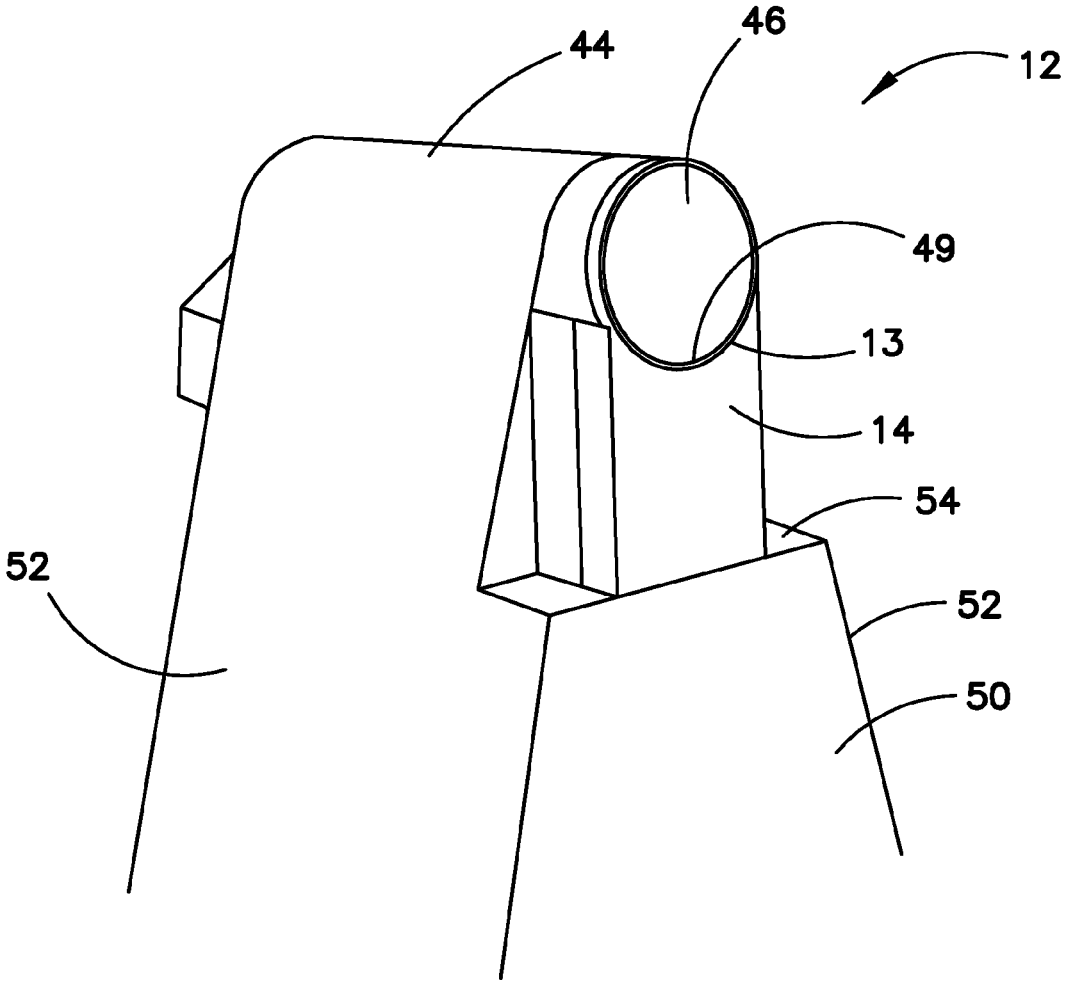
FIG. 11 is a perspective view of an upper portion of another cutter bit where the upper edge of the wear resistant element is formed to closely conform to the shape of the adjacent lower edge of the cutting surface.

In the embodiment of the cutter bit 12 shown in FIG. 11, the cutter bit can have an upper end 44 including a cutting surface 46 situated contiguous to the upper end 44. The cutting surface 46 can be formed of a diamond composition and can have a variety of shapes. A wear resistant element 14 can be replaceably mounted to the front surface 50 immediately below the cutting surface 46. The vertical and horizontal extent and shape of the wear resistant element 14 can be adapted as needed to protect the front surface 50 of the cutter bit 12 from excessive wear by contact with the abrasive drift removed from the surface being milled. The wear resistant element 14 can have an upper edge 13 that is formed to closely conform to the shape of the adjacent lower edge 49 of the cutting surface 46, can be received in a slot 54 in the front surface 50, and can extend substantially entirely between the lateral tapered surfaces 52. The wear resistant element 14 can have a variety of angular attitudes to deflect the passing drift away from the cutter bit body.

The foregoing detailed description should be regarded as illustrative rather than limiting, and the following claims, including all equivalents, are intended to define the spirit and scope of this invention

The invention claimed is:

1. A cutter bit adapted to be fixed onto a working surface of a milling, planing, mining or reclaiming machine, comprising:

an elongated body including a rounded upper end, a pair of lateral tapered surfaces extending from the rounded upper end toward a bottom end of the elongated body, and a front surface, wherein a pair of corners is formed by an intersection of the front surface and the pair of lateral tapered surfaces;

a wear resistant element coupled to the front surface; and a cutter element independently fixed to the front surface above the wear resistant element, the cutter element including an arcuate edge aligned with the rounded upper end of the elongated body, the cutter element including a pair of outwardly tapered side edges that extend longitudinally from the arcuate edge to a lower edge of the cutter element adjacent the wear resistant element, the pair of outwardly tapered side edges aligned with the pair of lateral tapered surfaces of the elongated body from the arcuate edge to the opposing lower linear edge, wherein the arcuate edge, the outwardly tapered side edges, and the lower edge define an outer perimeter of the front surface of the cutter element, and wherein the pair of lateral tapered surfaces extends laterally outward below the cutter element.

2. The cutter bit of claim 1, wherein the cutter element comprises polycrystalline diamond.

3. The cutter bit of claim 1, wherein the cutter element includes a front surface and an opposing back planar surface coupled to the front surface of the elongated body.

4. The cutter bit of claim 3, wherein the front surface of the cutter element extends from the arcuate edge to the wear resistant element.

5. The cutter bit of claim 1, wherein the cutter bit further comprises an opening through the elongated body immediately below the cutting surface from the front surface to the back surface of the elongated body, and a stem received in the opening, the wear resistant element being coupled to the front end of the stem.

6. The cutter bit of claim 1, wherein the pair of outwardly tapered side edges of the cutter element are aligned with the pair of corners of the elongated body from the arcuate edge to the lower edge, wherein the lower edge extends linearly between the lateral tapered surfaces, the cutter bit further comprising an upper portion including the elongated body, a lower stem portion, and a flange plate disposed between the upper portion and the lower stem portion, wherein a pair of non-tapered surfaces of a lower body of the elongated body extends upward from the flange plate to the corresponding lateral tapered surfaces.

7. The cutter bit of claim 1, wherein a lower edge of the cutter element abuts a first side of a partition included in the front surface of the elongated body, and the wear resistant element covers an opposing second side of the partition.

8. The cutter bit of claim 1, wherein the elongated body comprises hardened steel and the cutter element and the wear resistant element are independently coupled with the elongated body.

9. The cutter bit of claim 8, wherein the cutter element is fixed in a step formed in the front surface of the elongated body, the wear resistant element is disposed in a slot formed on the front surface of the elongated body, and the step and the slot are separated by a partition on the front surface of the elongated body such that the wear resistant element is spaced away from the cutter element by the partition.

10. The cutter bit of claim 1, wherein the cutter element comprises polycrystalline diamond, the elongated body comprises hardened steel, and the wear resistant element comprises a carbide composition or a sintered diamond composition, and wherein the wear resistant element includes an upper edge that conforms to a shape of an adjacent lower edge of the cutter element.

11. The cutter bit of claim 1, wherein the elongated body includes a back surface obverse to the front surface, and the rounded upper end extends perpendicular to the front surface from the front surface to the back surface of the elongated body.

12. A cutter bit comprising: an elongated body including a rounded upper end, a pair of lateral tapered surfaces extending from the rounded upper end toward a lower end of the elongated body, the elongated body comprising a front surface, a back surface obverse to the front surface, and a cutter element comprising polycrystalline diamond, the cutter element independently coupled with an upper end of the front surface of the elongated body, the cutter element including a front planar surface opposite to and extending along the front surface of the elongated body toward the lower end of the elongated body to an opposing lower linear edge of the front planar surface of the cutter element, an arcuate upper edge of the front planar surface aligned with the rounded upper end of the elongated body, and a pair of tapered side edges of the front planar surface outwardly tapered from the arcuate upper edge of the front planar surface to the opposing lower linear edge of the front planar surface, the pair of tapered side edges of the front planar surface of the cutter element aligned with the pair of lateral tapered surfaces of the elongated body from the arcuate upper edge to the opposing lower linear edge, the elongated body further comprising a wear resistant element mounted to the front surface of the elongated body immediately below the opposing lower edge of the cutter element.

13. The cutter bit of claim 12, wherein the pair of side edges of the cutter element is aligned with a pair of corners of the elongated body formed by an intersection of the front surface and the pair of lateral tapered surfaces, wherein the cutter element is a unitary structure, and a distance from the arcuate upper edge of the front planar surface to the opposing lower linear edge of the cutter element defines a total length of the unitary structure, wherein the opposing lower linear edge extends between the pair of corners.

14. The cutter bit of claim 12, wherein the opposing lower linear edge of the cutter element abuts a partition included on the front surface of the elongated body between the wear resistant element and the cutter element, and the wear resistant element covers the partition opposite the opposing lower linear edge of the cutter element.

15. The cutter bit of claim 12, wherein the elongated body comprises hardened steel, the wear resistant element comprises a carbide composition or a sintered diamond composition, and the wear resistant element has an upper edge that conforms to a shape of the opposing lower linear edge of the cutter element.

16. The cutter bit of claim 12, wherein the arcuate upper edge of the front planar surface of the cutter element is configured to contact a surface being milled, and the combination of the front planar surface and the wear resistant element cooperatively deflect, away from the front surface of the elongated body, abrasive drift removed from the surface being milled.

17. A cutter bit and mounting block adapted to be fixed onto a working surface of a milling, planing, mining or reclaiming machine, the mounting block comprising: a first side wall, a second side wall, and a top surface; a slot formed within the first side wall and extending through the top surface, the slot including first and second slot side walls, and a rear slot wall; at least one pocket formed within one of the first and second side walls to intercept the slot, and a retainer positioned within each pocket, each retainer including a planar laterally tapered surface; and the cutter bit comprising: an elongated body dimensioned to be removably mounted within the slot, the elongated body having a rounded upper end, a pair of lateral tapered surfaces extending from the rounded upper end toward a lower end of the elongated body, a front surface, and a back surface, the lower end including a surface having a portion engaged by the planar laterally tapered surface of each retainer to secure the cutter bit within the slot; and a cutter element independently fixed to an upper end of the front surface of the elongated body, the cutter element including an arcuate edge aligned with the rounded upper end of the elongated body, and the cutter element including a pair of outwardly tapered side edges that extend longitudinally from the arcuate edge to a lower edge of the cutter element adjacent the wear resistant element, the pair of outwardly tapered side edges aligned with the pair of lateral tapered surfaces of the elongated body from the arcuate edge to the opposing lower linear edge, wherein the arcuate edge, the outwardly tapered side edges, and the lower edge define an outer perimeter of the front surface of the cutter element.

18. The cutter bit and mounting block of claim 17, further comprising a wear resistant element mounted below the cutter element.

19. The cutter bit and mounting block of claim 18, further comprising an attachment element disposed along the back surface of the elongated body, wherein the cutter bit further comprises an opening through the elongated body immediately below the cutter element from the front surface to the back surface of the elongated body, wherein one of the wear resistant element and the attachment element includes a threaded stem received in the opening, and the other of the wear resistant element and the attachment element includes a threaded bore portion removably coupled to the threaded stem.

20. The cutter bit and mounting block of claim 17, wherein the cutter element comprises polycrystalline diamond, the cutter element includes a front surface, an opposing back planar surface coupled to the front surface of the elongated body, and a pair of outwardly tapered side edges that extend longitudinally from the arcuate edge to a lower edge of the cutter element, wherein the pair of outwardly tapered side edges of the cutter element is aligned with the pair of lateral tapered surfaces of the elongated body.

* * * * *